United States Patent [19]

Ishii

[11] 4,412,709

[45] Nov. 1, 1983

[54] DIVIDED CASH DRAWER WITH SLOTS AND TWO TRAYS

[75] Inventor: Shiro Ishii, Stanton, Calif.

[73] Assignee: M-S Corporation, Stanton, Calif.

[21] Appl. No.: 202,178

[22] Filed: Oct. 28, 1980

[51] Int. Cl.[3] ..... A47B 88/00; G07G 1/00

[52] U.S. Cl. ..... 312/291; 312/211; 312/333; 235/22; 206/0.81

[58] Field of Search ..... 312/291, 209, 211, 208, 312/333; 232/43.1; 206/0.81; 109/53, 54, 55

[56] References Cited

U.S. PATENT DOCUMENTS

| | | | |
|---|---|---|---|
| 495,934 | 4/1893 | Foote | 235/22 |
| 709,870 | 9/1902 | Clark et al. | 235/22 |
| 1,036,873 | 8/1921 | Maxwell | 235/22 |
| 1,396,361 | 11/1921 | Davidson | 206/0.81 |
| 2,547,512 | 4/1951 | Whitcomb . | |
| 2,604,975 | 7/1952 | Neilsen et al. | 235/22 |
| 2,629,863 | 2/1953 | Stern et al. | 235/22 |
| 2,642,985 | 6/1953 | Whitcomb . | |
| 2,681,730 | 6/1954 | Carne | 235/22 |
| 3,149,843 | 9/1964 | Braun . | |
| 3,405,985 | 10/1968 | Higer | 312/211 |
| 3,592,521 | 7/1971 | Cox | 312/333 |
| 3,708,709 | 1/1973 | Morrison et al. | 312/209 |
| 4,314,632 | 2/1982 | Hutchinson | 232/43.1 |

*Primary Examiner*—Victor N. Sakran

*Attorney, Agent, or Firm*—Wenderoth, Lind & Ponack

[57] ABSTRACT

A cash drawer includes a separate compartmented money tray which is removable therefrom. The removable money tray is compartmented both for bills and coins. The drawer includes a number of compartments in the bottom thereof and slots in the front wall of the drawer which correspond to each of the compartments. When the money tray is received in the drawer, different kinds of media such as checks, slips, or coupons can be stored in the drawer by inserting the appropriate media through a corresponding slot so that it is guided by the bottom face of the money tray into a corresponding compartment in the bottom of the drawer.

2 Claims, 8 Drawing Figures

DIVIDED CASH DRAWER WITH SLOTS AND TWO TRAYS

BACKGROUND OF THE INVENTION

The present invention relates to a cashbox or drawer of use in financial institutions, stores, or other establishments wherein small amounts of money are to be handled. The device is of use to clerks for making change, to professional offices in keeping petty cash, to bank tellers in handling withdrawals, and in many other like situations.

More particularly, in stores such as category stores, there is often a need to handle coupons as well as money which is in the form of bills. Conventional cash drawers are normally of the construction wherein a tray is positioned inside a drawer with the tray being a compartmented tray which contains different denominations of bills as well as coins. When handling coupons, checks, slips, or the like, it is impossible to store such items under the money tray without opening the cash drawer and removing the money tray. Further, since the area under the money tray is not compartmented, the different kinds of media usually become mixed. Still further, the conventional cash drawers do not allow enough space for the storage of large volumes of coupons, checks or the like.

To remedy these problems, several cash drawers have been proposed. One attempt at remedying the problems included installing a storage area for checks at the side of the money tray and providing a slot on the front of the drawer through which the media could be inserted into the storage area. This effort proved unsatisfactory, however, since it did not allow enough room to provide compartments corresponding to each individual type of media, i.e. checks, coupons, slips, etc., so that the media was still in disarray. Further, if such compartments were to be provided, it becomes necessary to double the width of the drawer and this resulted in difficulty in operating the cash register itself.

SUMMARY OF THE INVENTION

Thus, it is an object of the present invention to provide a cash drawer which allows storage of media such as coupons, checks, slips, etc., without requiring the opening of the cash drawer and removing of a money tray therein.

Another object of the present invention is to provide a cash drawer having a compartmented media storage area which allows separation of the different kinds of media.

To accomplish these and other objects an extra tray with compartments for media and storage for wrapped coins is provided under the regular removable money tray in a cash drawer. Further, slots are provided on the front wall of the cash drawer, which slots correspond to the compartments for the media so that media can be inserted into the compartments without opening the cash drawer itself.

The features of the invention will become more readily apparent from the accompanying drawings, when taken in connection with the following detailed description of the invention.

DETAILED DESCRIPTION OF THE PREFERRED EMBODIMENT

Figure 1:
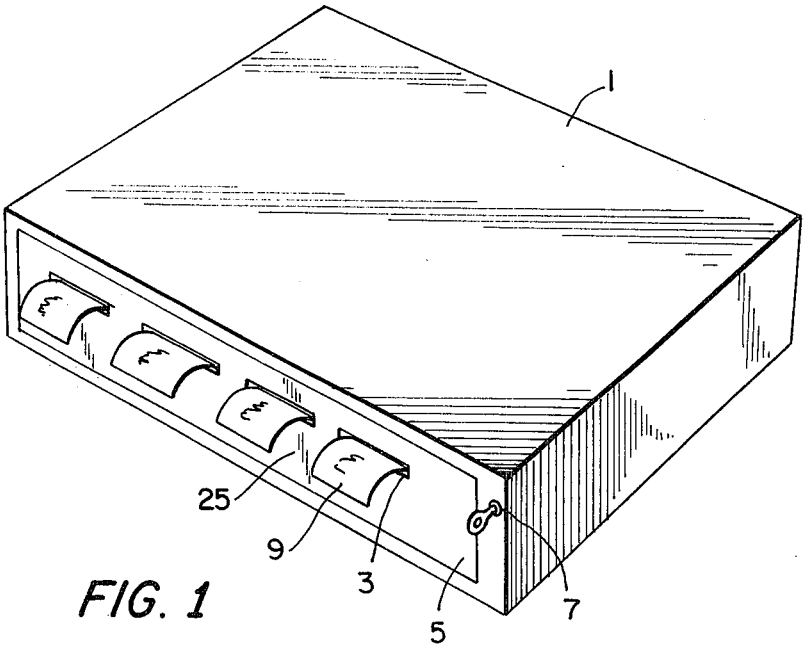
FIG. 1 is a perspective view of the cash drawer of the present invention in closed position and showing various different kinds of media being inserted through the slots in the front wall.
Figure 2:
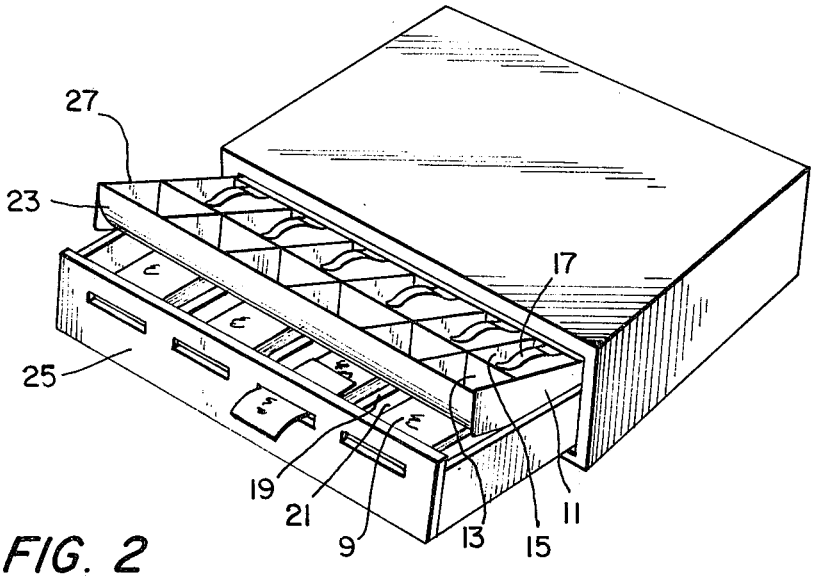
FIG. 2 is a perspective view of the cash drawer of FIG. 1 with the drawer open and the money tray raised so as to show the compartmented tray which is located beneath.
Figure 3:
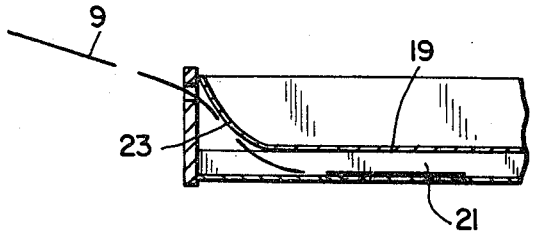
FIG. 3 is a cross-sectional side view of the drawer having the money tray therein of the present invention.
Figure 4:
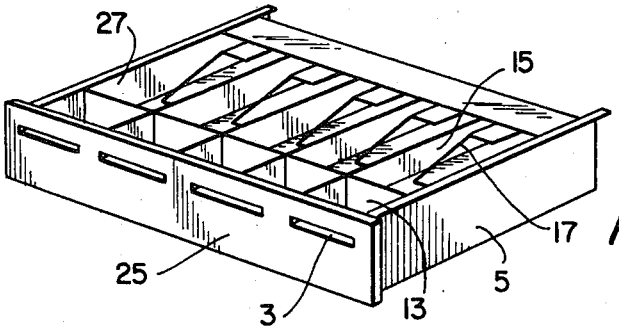
FIG. 4 is a perspective view of the drawer of the present invention showing the drawer by itself with the money tray therein.
Figure 5:
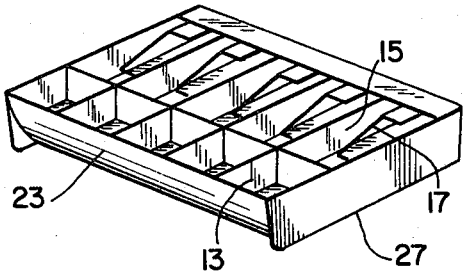
FIG. 5 is a perspective view of the money tray of FIG. 4.
Figure 6:
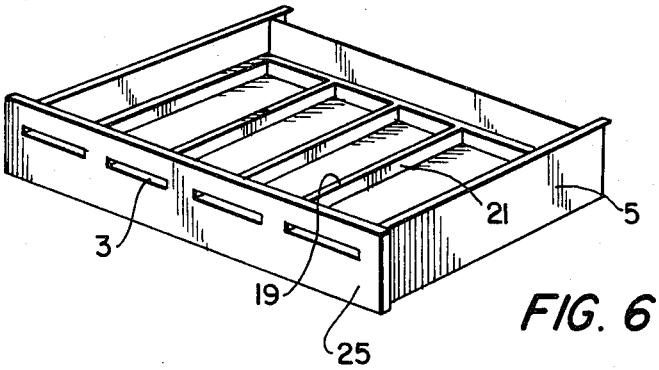
FIG. 6 is a perspective view of the drawer with the money tray removed.

The present invention includes a drawer 5 which is received in an outer case 1. Once closed, the drawer can be maintained closed by a lock and key as shown by the numeral 7 in FIG. 1.

The drawer 5 has a number of compartments 21 in the bottom thereof, the compartments 21 are defined by dividing supports 19. Further, the front wall 25 of the drawer has a plurality of slots 3, which are at least four but can be any number which is greater, therein which correspond respectively to the compartments in the drawer 5.

There is a money tray 27 which is received and contained within the drawer 5. Further, the dividing supports 19 serve to support the money tray 27 in a stable manner within drawer 5.

The money tray includes a plurality of subdivided coin compartments 13 as well as a plurality of bill compartments 15. The springs 17 serve to hold the bills within the compartments 15.

When in use, the money tray is received within the drawer 5 so that when it is desired to have access to cash, one simply has to open the drawer. In the event that the drawer is closed and the user receives media 9 such as checks, slips or coupons, the media is stored without requiring the opening of the drawer. More particularly, depending upon the kind of media in question, a slot 3 is selected which corresponds to the particular media 9 and the media 9 is inserted therethrough. When the media 9 is inserted through the slots, the arcuately inclined wall 23 of the money tray serves to guide the media into a correct and flat position within the corresponding compartment 21 of the drawer.

Figure 7:
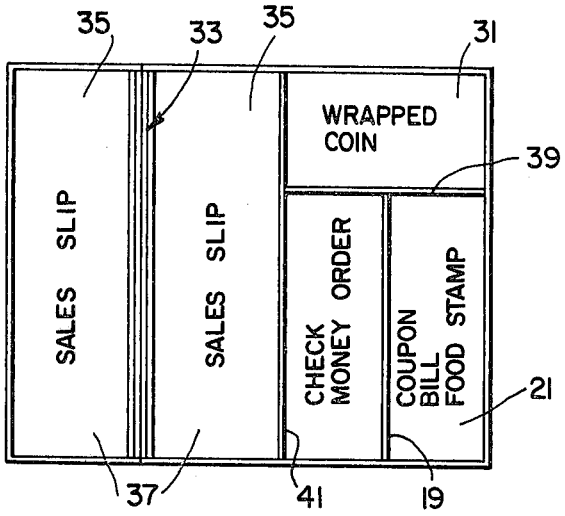
FIG. 7 is a plan view of an alternative embodiment of the bottom of the drawer of the present invention.
Figure 8:
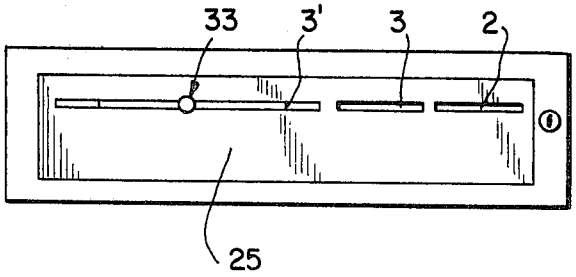
FIG. 8 is a front view of the drawer of the alternative embodiment of the present invention which is used with the bottom of FIG. 7.

An alternative embodiment of the drawer 5 is shown in FIG. 7. More particularly, the drawer 5 of FIG. 7 includes a large section 37 which can be separated into two sections 35 by a removable divider 33. Accordingly, as shown in FIG. 8, the slots in the front of the drawer would have to be modified to include a large slot 3' on one side instead of the four regular slots 3. Further, the bottom of the drawer would also be modified to include a wrapped coin compartment 31 which is divided from the regular compartments 21 by wall 39. The dividing wall 19 between the compartments 21 has thus been shortened. Finally, the wrapped coin compartment 31 and compartments 21 would be divided from the large section 37 by dividing wall 41.

Having thus described the present invention in detail, the scope of the invention will be defined in the following claims.

What is claimed is:

1. A cash receptacle for storing different types of media, said receptacle comprising:

an outer case having an opening in one side thereof;

a drawer slidably received within said case through said opening therein;

said drawer having in the bottom thereof a plurality of dividing supports partitioning said bottom of said drawer into a plurality of drawer compartments including one large compartment having adjustable means for dividing said large compartment into two compartments, two smaller compartments located adjacent said large compartment, and a coin compartment located behind said two smaller compartments within said drawer;

a money tray removably supported in said drawer on said dividing supports;

said drawer having in a front wall thereof a plurality of slots including a slot corresponding to said large compartment and two individual slots corresponding to said two smaller compartments, said slots being located in said front wall at a level above the respective said drawer compartments and facing a front wall of said money tray; and said front wall of said money tray being curved downwardly and rearwardly from the top front of said money tray, thereby forming means for guiding media inserted through said slots into respective said drawer compartments beneath said money tray.

2. A cash receptacle as claimed in claim 6, wherein said outer casing includes a lock for locking said drawer in a closed position.

* * * * *